United States Patent [19]

Martin

[11] Patent Number: 4,724,945

[45] Date of Patent: Feb. 16, 1988

[54] METHODS AND APPARATUS FOR TURNING FLAT ARTICLES

[75] Inventor: Samuel W. Martin, Weston, Conn.

[73] Assignee: Pitney Bowes Inc., Stamford, Conn.

[21] Appl. No.: 2,487

[22] Filed: Jan. 12, 1987

[51] Int. Cl.[4] ..... B65G 47/24

[52] U.S. Cl. ..... 198/412; 198/416; 198/633; 271/184; 271/225

[58] Field of Search ..... 198/412, 411, 416, 624, 198/633; 271/225, 184, 185, 250, 251; 83/107, 156

[56] References Cited

U.S. PATENT DOCUMENTS

| | | | |
|---|---|---|---|
| 3,059,753 | 10/1962 | Lisinski | 198/411 |
| 3,605,980 | 9/1971 | Donahue et al. | 198/457 |
| 3,758,104 | 9/1973 | Daily | 271/185 |
| 3,898,432 | 8/1975 | Agnew et al. | 271/250 X |
| 3,964,739 | 6/1976 | Garcia | 271/250 X |
| 4,085,839 | 4/1978 | Crawford | 198/410 |
| 4,448,407 | 5/1984 | Bashford | 271/228 |

FOREIGN PATENT DOCUMENTS

| | | | |
|---|---|---|---|
| 2312823 | 9/1973 | Fed. Rep. of Germany | 198/416 |

*Primary Examiner*—L. J. Paperner
*Assistant Examiner*—Jennifer Doyle
*Attorney, Agent, or Firm*—Lawrence E. Sklar; David E. Pitchenik; Melvin J. Scolnick

[57] ABSTRACT

Apparatus for turning flat articles supported on a substantially flat surface, including a device for receiving a serial stream of the articles, each of which travels along a first linear path, and a device for rotating each article through a preselected angle and for then steering the articles in a preselected direction. The rotating device includes a first and second pair of fixed, positioned rollers whose axes are located at substantially a right angle to each other. The apparatus further includes a guiding device and a conveyor which causes the articles to move along a path which is parallel to the preselected path of travel. The apparatus is utilized in executing a method of receiving, rotating and conveying the articles along the preselected direction.

18 Claims, 7 Drawing Figures

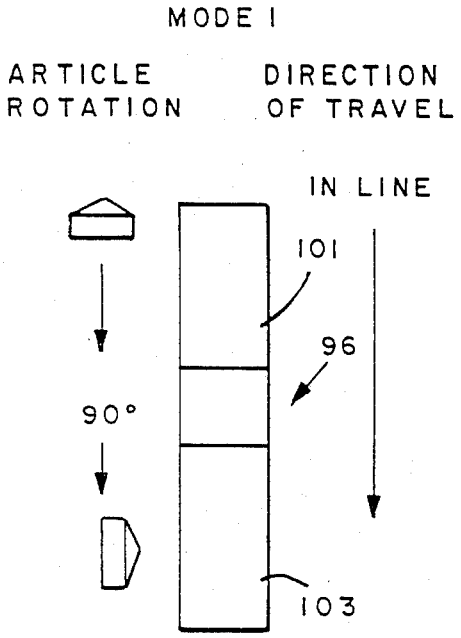
FIG. 2
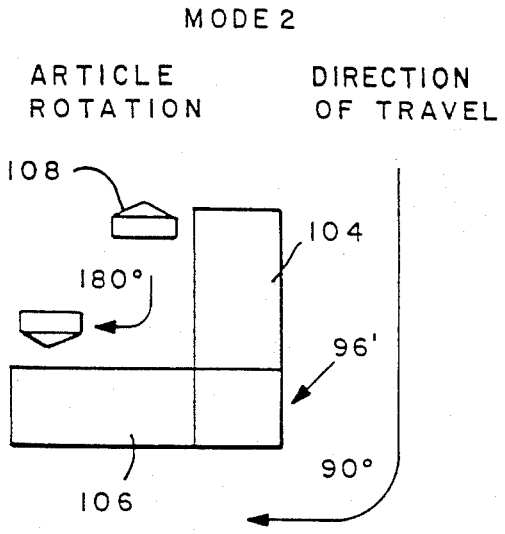
FIG. 3
FIG. 4
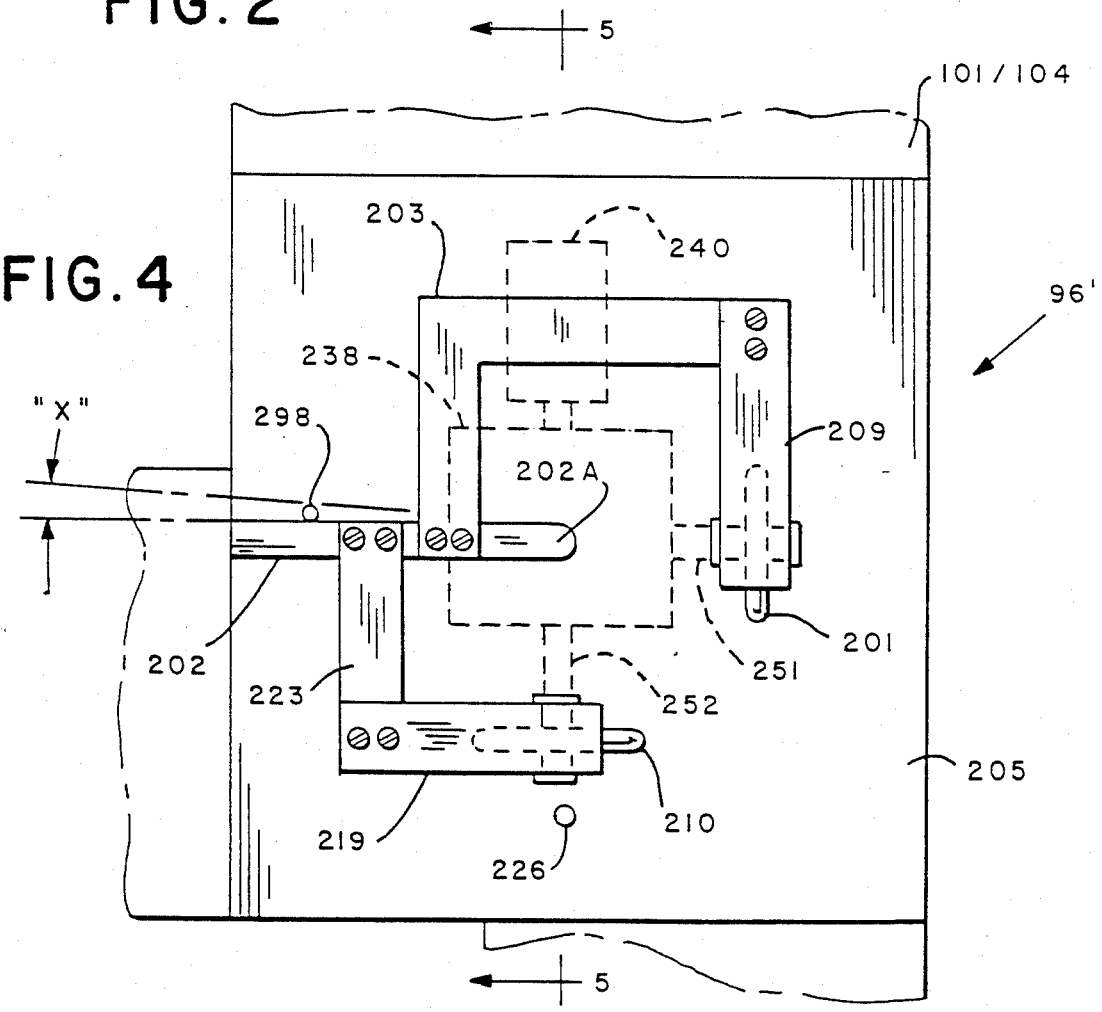

METHODS AND APPARATUS FOR TURNING FLAT ARTICLES

BACKGROUND OF THE INVENTION

1. Field of the Invention

The invention relates generally to methods and apparatus for turning flat articles and is particularly related to methods and apparatus used for turning envelopes.

2. Description of the Related Art

Turning devices for flat articles that are conveyed horizontally are required in mail processing machines. Examples of flat articles are envelopes, letters, postcards, endless forms issued by a computer controlled printing device that are cut into sheets from an endless web and the like. For example, in an inserter and mail processing machine, sheets are fed one by one, or collected together, to a folding station and subsequently, with or without additional enclosures, are conveyed to an inserting station where the sheets are inserted into an envelope.

After insertion of the sheets into the envelope, the stuffed envelope is forwarded to a postage station where postage is imprinted thereon by a postage meter. In certain inserters, it is necessary to turn the stuffed envelopes either through a 90° or a 180° angle. The first through the postage meter is the same as the direction of discharge from the inserting station and the second case is required if the postage meter is connected to the inserting station at a 90° angle relative to the direction of discharge.

In a known device of this kind, as described in U.S. Pat. No. 2,746,221, the envelopes are transferred with their length perpendicular to the direction of travel through the inserting station and are received by a rotatable turntable device. The device is driven by the main motor of the inserter through a mechanism in such a manner that horizontally disposed movable gripping arms are provided along with a clamping device which engage the envelope to clamp it on the rotatable table of the turning device and retain it until the envelope has been turned 180° by rotation of the turntable. Thereafter, the envelope is received by the postage station, which is located at a 90° angle relative to the direction of travel of the inserting station, and the envelope is then fed to the postage station. In this device, however, the gripping arms, which are controlled by a cam disc, cause a predetermined spring force to be applied to the envelope on the rotatable turntable during its angular rotation so that there exists different pressing forces upon envelopes of different thickness.

Additionally, a relatively high noise level is occasioned by the cam disc for controlling the gripping arms as well as the Geneva motion required for driving the turntable. Particularly, lowering of the arms creates noise. Further yet, because the components suffer relatively high wear, the wear on the gripping arms may result in envelopes no longer being securely clamped, particularly at high processing speeds.

To solve the aforementioned problems, the assignee of the instant invention has disclosed a turning device with a modified clamping mechanism, for turning flat articles through a preselected angle, in copending application Ser. No. 718,327 filed on Apr. 1, 1985, now abandoned, entitled "DEVICE FOR TURNING FLAT ARTICLES" in the name of Karl-Heinz Abels, which is hereby incorporated by reference.

The apparatus disclosed in the incorporated application includes a clamping device having two coaxially aligned discs which are coupled to rotate in unison and are axially movable towards one another. The articles to be turned are inserted between the two discs and can be discharged at a predetermined angular position. The clamping device is provided with a driving mechanism by which the discs can be moved between axially spaced apart positions. When a predetermined pressing force is attained upon an article being retained by the discs, the discs can be locked in position during the angular rotation of the turntable unit in order to maintain a constant pressure on the articles being turned.

Still, the object to be turned must first be gripped by the clamping device, i.e., be locked for a period of time between the retaining discs and then be released at the appropriate time after the article has been turned through the predetermined angle.

Other known types of turning devices are typified by Daily in U.S. Pat. No. 3,758,104, issued Sept. 11, 1973, entitled "TURNING APPARATUS", which instead of using a clamp comprised of 2 discs to grab and release an article, involves a conveyor and means forming two nips generally transverse to the conveyor to turn an article.

According to Daily, an inward disc is mounted on a shaft above the conveyor and is freewheeling with respect to the shaft in order to form a first article engaging nip with the conveyor. An outward disc is secured to the shaft and forms a second article engaging nip with a third disc freely mounted beneath the outward disc on a shaft which drives an end roll of the conveyor.

The outward disc is driven at a speed greater than that attained by the inward disc by virtue of its engagement with the conveyor or a moving article thereon.

When, for example, an envelope is conveyed toward the discs, a portion is caught in the nip formed by the outward disc and the third disc. This portion of the envelope is accelerated while the portion of the envelope between the conveyor and the freewheeling disc remains at conveyor velocity. The envelope is thus turned about that area between the conveyor and the freewheeling disc and is discharged from the conveyor to further apparatus such as a postage meter device.

The apparatus disclosed in U.S. Pat. No. 3,758,104, although providing means to turn an article without using the prior art clamping arrangement, does not accommodate turning articles 180°, requires two discs for the 90° turn alone, and requires a conveyor belt between the rotating discs to turn the article. The conveyor belt as a part of the turning device apparatus introduces a separate maintenance and operating element and will be seen to be an unnecessary element to provide 90° and 180° turning capabilities in a turning device.

The prior art also encompasses article turning devices, typified by Crawford in U.S. Pat. No. 4,085,839, which do not require rotating discs or clamps. In the Crawford Patent a conveyor belt is again required, but this time is used with side belts for grasping an article to achieve a 90° rotation. Still further, Bashford et al. In U.S. Pat. No. 4,448,407, issued May 15, 1984, and Bashford in U.S. Pat. No. 4,506,878, issued Mar. 26, 1985, teaches sheet moving apparatus comprising a combination of a rotatable member, such as a disc, and a movable or pivotal member, including an engaging roller, to change the track in which a document is being conveyed. The Bashford apparatus requires movement of the pivotal member and engagement of one or more rollers with the rotating turntable in order to change the track of an article. In addition to all these moving parts, Bashford does not accommodate applications where the article needs to be turned 180°.

In addition to all of the aforementioned problems related to moving parts, noise and wear, the known prior art equipment is bulky, costly and not safe to operate particularly in view of the number of high-speed moving parts exposed to the operator.

It has been determined that it would be advantageous to have an article turning device not requiring a conveyor mechanism to perform the turning per se. In this way the device could be made modular; i.e., could be married to a variety of devices which deliver and/or receive the articles by any known means, e.g., conveyor; injection, etc.

Still further, it has been determined that it would be advantageous to have a turning device, with a minimum number of moving parts, that is easy to maintain, is quiet, and is capable of selectively rotating articles through 90° or 180°. This would be particularly useful in the aforementioned inserter and mailing machine combinations where the position of the mailing machine determines how far the envelopes need to be turned. Further yet, it would be advantageous to have a turning device which is inherently safe to operate with a minimum number of high speed moving parts exposed to an operator.

SUMMARY OF THE INVENTION

According to the present invention, flat articles are turned and conveyed through an apparatus in one of two preselected modes. There is included in the apparatus an apparatus for receiving a serial stream of articles such as envelopes which are traveling along a first linear path. There is further apparatus for rotating each of the articles through a preselected angle, and for steering each article in a preselected direction of travel. The rotating and steering apparatus includes a first and second pair of fixed, positioned rollers, the axes of which are located at a substantial right angle with respect to each other. There is an apparatus for guiding each of the articles too. A conveying device is then utilized to convey each rotated article along a path parallel to the preselected direction of travel.

The present invention additionally constitutes a method for turning flat articles. The method includes receiving a serial stream of articles, each traveling along a first lineal path. Each article is then rotated through a preselected angle and steered in a preselected direction of travel by a first and second pair of fixed positioned rollers having axes disposed at right angles with respect to each other. Each article is then guided to at least the first pair of rollers. Finally, each article is then rotated down a path which is located in parallel relationship with the preselected direction of travel.

The apparatus includes a fixed position fence for guiding the articles to the conveying nip of the first pair of rollers.

Therefore, having briefly described the present invention in the foregoing summary, a brief description of the drawings which shows details of the invention is now given. In addition, having described briefly the present invention in the foregoing summary, it will be seen that there is presented a new and novel way of turning articles in a preselected manner. The present invention affords the opportunity to handle articles such as envelopes by the utilization of an apparatus which is now described in the following brief description of the drawings.

BRIEF DESCRIPTION OF THE DRAWINGS

FIG. 2 is a block diagram of a combination of an inserting machine, turning device and mailing machine.

FIG. 3 is an alternative layout in a block diagram of a combination of an inserting machine, turning device and mailing machine.

FIG. 4 is a top view of the turntable device shown in FIG. 1.

DESCRIPTION OF THE PREFERRED EMBODIMENT

Figure 1:
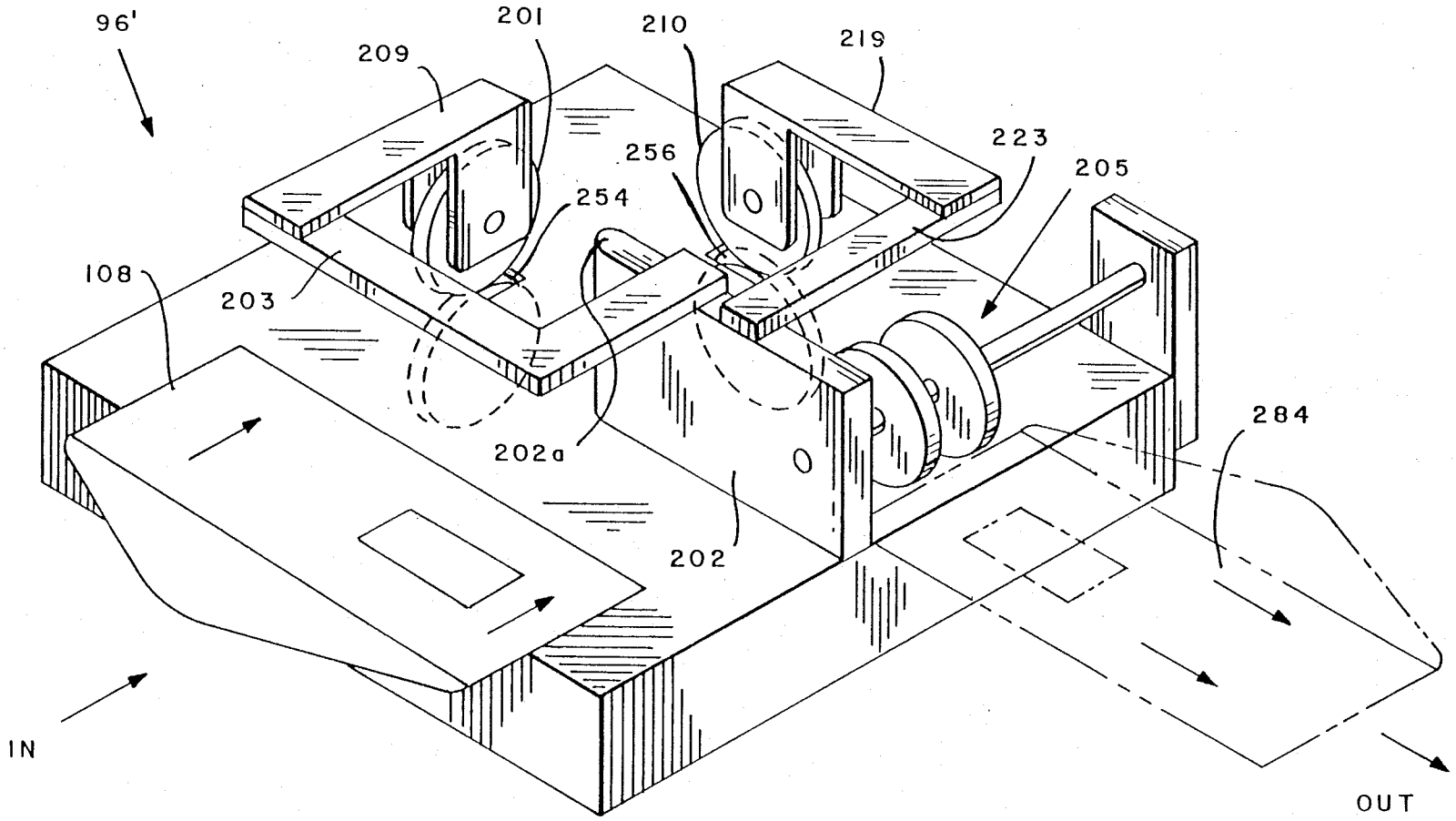
FIG. 1 is an isometric view of the turntable device constituting the present invention.
Figure 7:
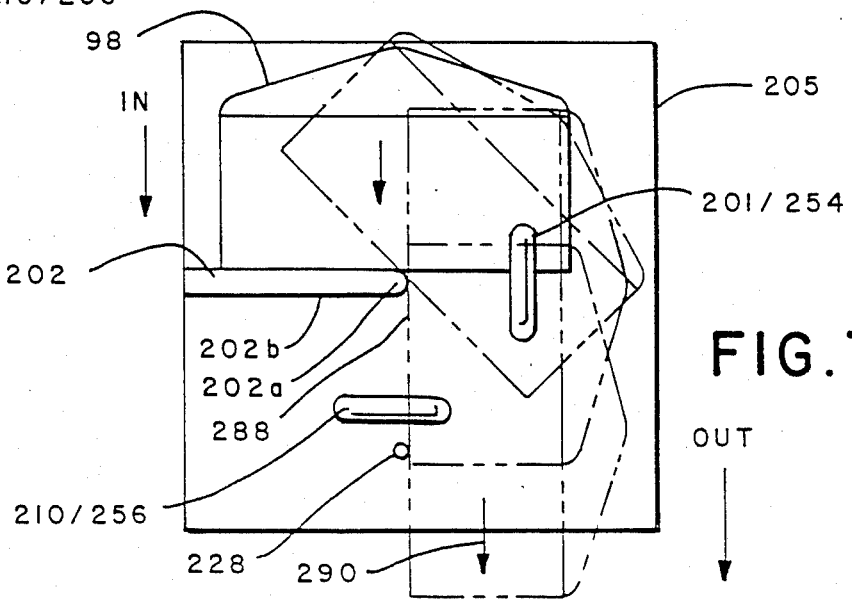
FIG. 7 is a top view of the turntable device which shows several positions of an envelope being turned through a 90° angle as defined by the diagram shown in FIG. 3.

Referring to FIG. 1 there is shown an isometric view of a turntable device 96', which is set up in one of two possible arrangements designated Mode 1 and Mode 2 in order to turn an envelope 98 through an angle of 90° or 180° which will accommodate alternative paths of the envelope 98. The arrangement shown in FIG. 1 is for turning the envelope 98 through a 180° angle per the requirements in a "Mode 2" operation, as will be described in the following specification. The alternative arrangement termed Mode 1 is seen in a block diagram (FIG. 2), and is explored later in the present specifications with further reference to FIG. 7. The differences being noted when compared to FIG. 3. In FIGS. 2, 4 and FIG. 7, the 90° Mode 1 turning function will be seen and understood as one refers to the later accompanying specification.

Within FIGS. 2 and 3, there is, a block diagram form, two separate combinations of an inserting machine, turning device and mailing machine. The novel turning device otherwise is known as a "turntable" described in the context of the inserter/mailing machine combination to illustrate the preferred embodiment of the invention.

In FIG. 2, there is an inverter 101, the turning device 96 and a mailing machine 103 are shown "in line", i.e., with the direction of travel of articles through the mailing machine in the same direction as through the inserter 101. This will institute a "Mode 1" operation, and according to the example of a preferred context in which the invention may be utilized, the objective is to turn an article, such as the envelope 98 (FIG. 2) 90° prior to the continued in-line movement of the article through the mailing machine. This facilitates applying a postage indicia to a corner of the article by a postage meter which is typically part of the mailing machine.

Mailing machines may also include other devices, e.g., an envelope flap closing device. Postage meters, flap closing devices, etc., which receive articles from the turning device, are standard, commercially available items which are available from for example, Pitney Bowes of Stamford, Conn. The Inserter 101 is also a standard, commercially available item, typified by various products manufactured by Pitney Bowes, of Stamford, Conn.

The portion of FIG. 3 depicts a combination of an inserter 104, a turning device 96' and a mailing machine 106. It is seen that the inserter 104, and mailing machine 106 are not in line as they are shown in FIG. 2. Here the mailing machine 106 is stationed at a right angle with respect to the inserter, and an article, such as an envelope 108 needs to have its direction of travel changed, i.e., be "steered", by 90°, in addition to having to be rotated by 180° for postage to be properly affixed at the aforemention location.

To perform the desired rotation and steering of articles, the turning device 96 and 96' of the preferred embodiment of the invention is operative in either Mode 1 or Mode 2 which is shown in the equipment configurations depicted in the portions of FIG. 2 and FIG. 3.

FIG. 4 depicts a plan view of a turning device 96' constructed in accordance with the preferred embodiment (Mode 2) of the invention.

Figure 5:
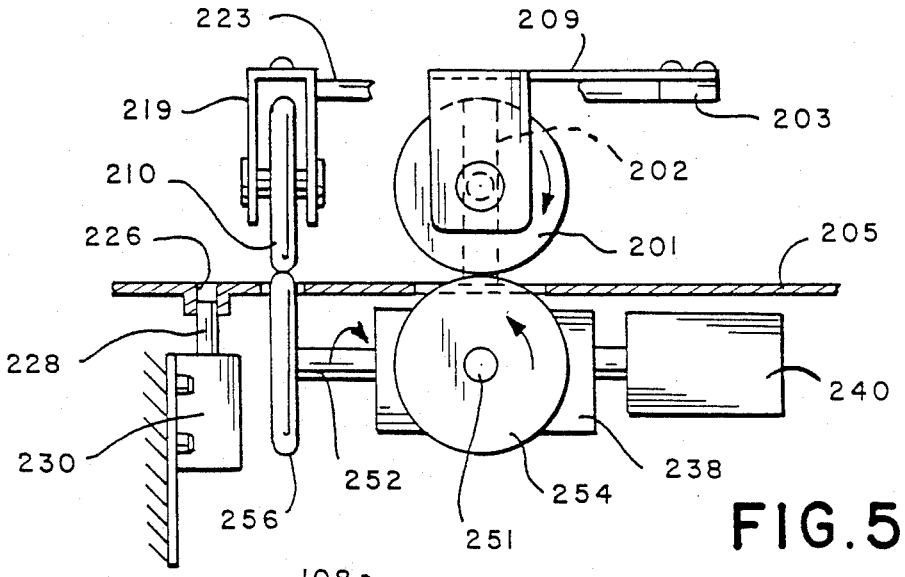
FIG. 5 is a partial sectional view taken along the lines of 5—5 from FIG. 4.

It will be understood that device 96 and 96' (FIGS. 2 and 3) are essentially the same for the purposes set forth in the present specification. Referring to FIGS. 4 and 5, a fixed position idler roller 201 is bracketed to a fixed fence 202 via a bracket 203. The fence 202 constitutes a guide for the articles, and thus is the principal registering member for proper alignment of the articles being rotated. The roller 201 is coupled to the bracket 203 via an idler mount 209. The Mount 209 is preferably made of spring steel or other suitable resilient material to permit the roller 201 to move up and down towards a deck 205 in order to accommodate different envelope thicknesses. The centerline of the roller 201 is in line with a pivot point 202A shown as a part of the fixed fence 202. Similarly bracketed to the fixed fence 202 is the combination of a fixed position idler roller 210, an idler mount 219 and a bracket 223 all of which are appropriately fastened together by screws or other well-known means.

Referring to FIG. 5, a hole 226 in the deck 205, is provided in the preferred embodiment of the invention to permit a pin 228 to be selectively raised and lowered above the level of the deck 205 by a solenoid 230 which is appropriately connected to the pin 228 located and secured beneath the deck 205. The purpose of the pin 228 and the solenoid 230 will be detailed hereinafter with reference to FIG. 5 where they are depicted in greater detail.

In addition to the above, FIG. 4 depicts, via dotted lines, a portion of the turning device, and associated drive apparatus which is secured beneath the deck of the turntable device 96. In particular, a gear box 238, a motor 240 and axles 251 and 252 are depicted. One of ordinary skill in the art will readily appreciate that the motor 240, the gear box 238 and the axle combination may be used to rotate respective drive rollers located directly under the idler rollers 201 and 210. Referring to FIG. 5 there is a roller 254 located beneath the idler roller 201, and a roller 256 is similarly located beneath the roller 210. Both rollers 254 and 256 are appropriately mounted on the axles 251 and 252 and are continuously driven by the aforementioned motor 240 which is connectively engaged with the gear box 238. The above described structure will become more apparent with further reference to FIG. 5.

In FIG. 5, one can see the idler roller 201, bracket 203, mount 219, idler roller 210 and mount 219 all from FIG. 4. In addition, one may refer to the motor 240, gear box 230 and the axle 252. Separately driven drive rollers 254 and 256 are shown with their respective nips defined by engagement with the idler roller 201 and 210 respectively. The nip of each roller pair is slightly raised aove the deck 205. The roller combination 201/254, and 210/256 constitutes a rotating apparatus for the envelopes. The roller combinations 201/254 and 210/256 are located at a substantial right angle to each other. It will be understood that within each roller combination 201/254 and 210/256, one of each roller is a driven or "driver" roller while the other is an idler or "driven" roller.

The gear box 238 converts CW rotary motion of the axle 252 to a counterclockwise motion for the drive roller 206. Idler roller 201 opposes this motion by turning clockwise. An envelope such as the envelope 98 or other article directed to the nip of the roller 201/254, is caught by the nip and the roller pair 201/254, begins the rotation and steering process referred to hereinbefore.

Figure 6:
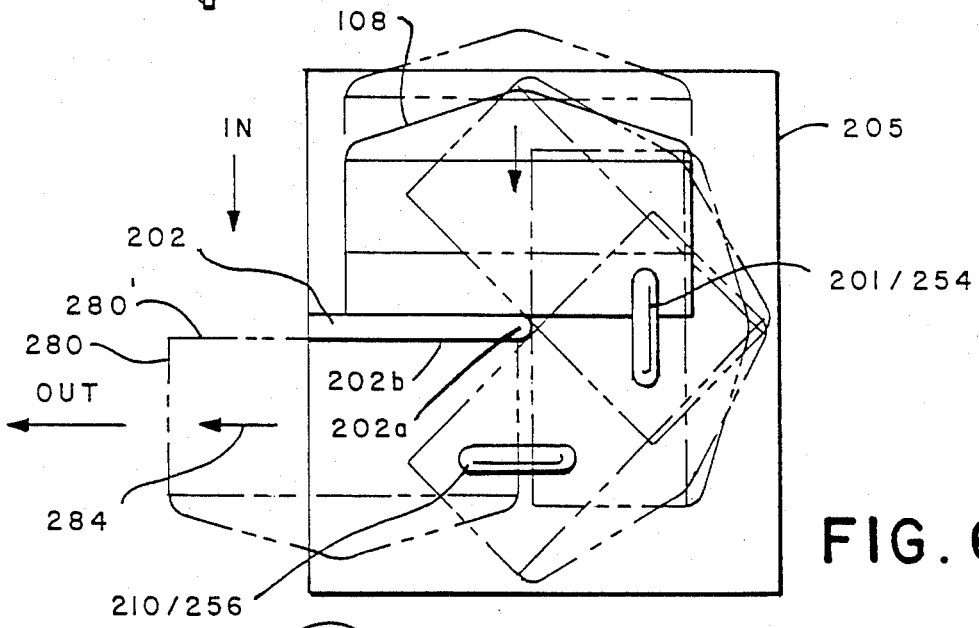
FIG. 6 is a top view of the turntable device, which shows several positions of an envelope being turned through a 180° angle, as defined by the diagram shown in FIG. 2.

Reference should now be made to FIG. 6 which depicts the path of the envelope 108 conveyed by the roller pairs 201/254 and 210/256. It can be seen that the path of the envelope 108 is a 180° arc. At the 90° point in the swing over the envelope, the roller pair 210/256 comes into play since the solenoid 230, shown in FIG. 5, has not placed the pin 228, in a position to prevent the nip of the roller pair 210/256 from grabbing the envelope. (This event to be described later).

Solenoid 230 is meant to be operative in the mode 2 referred to hereinbefore, i.e., when a 180° turn of the article is contemplated, to keep the pin 228 below the deck 205, i.e., to permit the nip of the roller pair 210/256 to grab the envelope 98. In the mode 1 referred to hereinbefore, i.e., the 90° turn of the article, the solenoid 230 is operative to permit the pin 228 to raise above the deck 205 (thru the hole 226 see FIG. 5) to prevent the nip of roller pair 210/256 from grabbing the envelope 108.

The net result of the "pin down" position is that the envelope 108 continues along the 180° path depicted in FIG. 6. The roller pair 210/256, which grabs the envelope when the roller 201 is at the 90° point, is shown to cause the envelope 108 to move along a straight path 284 after the 180° turn. Thus, the envelope 108 is in a position 280, and is moving along the path 284, in a direction substantially parallel to the fixed fence 202. Thus an edge 280' of the envelope 108 is aligned with a surface **202*b* of the fence 202. The envelope 108 is thus rotated 180° and steered 90° from its original direction of travel and is caused to move along the outward path 284**.

Alternatively at a predetermined setup, the net result of the "pin up" position is that the envelope 108 only traverses 90° of the 180° path shown in FIG. 6 and then follows a straight path 290 which is parallel to the envelope's 98 original direction but having caused the envelope to be reoriented 90°. This is best seen in FIG. 7. The Roller pair 210/256 obviously never grabs the envelope in this case. The envelope 98 is thus rotated 90° and then urged out along its original direction of travel to facilitate operations of the alternative equipment configuration depicted in FIG. 2.

FIG. 6 and FIG. 7 depict various positions which track an envelope being rotated 180° and 90° respectively as has been described in the preceding text. The 180° turn diagram (FIG. 6) corresponds to the hereinbefore referenced mode 2 operation of the preferred embodiment of the invention. The 90° turn diagram (FIG. 7) corresponds to the hereinbefore referenced mode 1 operation of the invention.

Referring to FIG. 7 the pickup by the roller pair 201/254, causes the envelope 98 to pivot about the point 202a. The envelope 98 then is rotated 90° so that an edge 288 of the envelope 98 guides against the pin 228. This is representative of the "Mode 1" handling of the articles (envelopes) wherein those envelopes are swung 90° and are caused to proceed seriatim along an outward feed path 290.

The preferred embodiment of the invention (Mode 2) also calls for some means to angularly bias an envelope moving towards the turning device to insure it is caught in the nip of roller pair 201/254. Referring back to FIG. 4 a post or pin 298 is located along the side of the fence facing the inserting device shown as post 298 would be utilized to perform the desired biasing. Alternatively, the fence would be thicker at this point to provide the angle "X" shown in FIG. 4. This biasing is particularly desirable if thin envelopes are being processed and will relieve any doubt that the envelope will be caught by the nip of the roller pair 201/254.

What has been disclosed is a novel turning device which, for the sake of illustration only, was demonstrated as being useful in combination with an inserting machine and mailing device. Obviously, other combinations of equipment and uses for the turning device and methods described herein are possible. For example, the turned articles could be further sorted by apparatus not shown or described herein.

Still further, the foregoing description of a preferred embodiment of the invention was not intended to be exhaustive or to limit the invention to the precise form disclosed, and obviously many modifications and variations are possible in light of the above teaching. The embodiment was chosen and described in order to best explain the principles of the instant invention and its practical application to thereby enable others skilled in the art to best utilize the instant invention in various embodiments and with various modifications as are suited to the particular use contemplated. It is intended that the scope of the instant invention be defined by the claims appended hereto.

What is claimed is:

1. Apparatus for turning flat articles, comprising:

(a) means for receiving a serial stream of said articles each traveling along a first linear path;

(b) means for rotating each of said articles of said stream through a preselected angle and for steering each of said articles in a preselected direction of travel wherein said rotating and steering means includes (i) a first and second pair of fixed, positioned rollers the axes of which are located at substantially a right angle to one another, and (ii) means which in a first mode urges said articles to continue along said first linear path and in a second mode urges said articles to progress along a second linear path at a substantially right angle to said first linear path;

(c) means for guiding each of said articles to said rotating and steering means; and (d) means for conveying each of said rotated articles along a path parallel to said preselected direction of travel.

2. Apparatus as set forth in claim 1 wherein said receiving means includes a structural support including a substantially flat surface for serially receiving said articles.

3. Apparatus as set forth in claim 2 wherein said rotating and steering means further comprises means for rotatably supporting said first and second pair of rollers so that their respective conveying nips are slightly elevated above said flat surface in order to engage said articles guided thereto.

4. Apparatus as set forth in claim 1 wherein each of said roller pairs includes a driver roller and an idler roller.

5. Apparatus as set forth in claim 4 further comprising means for driving said drive rollers.

6. Apparatus as set forth in claim 3 wherein said roller pairs are capable of conveying articles of varying thickness.

7. Apparatus as set forth in claim 6 wherein said ability to convey articles of varying thickness is achieved by resiliently biasing one roller of each of said pair of rollers.

8. Apparatus as set forth in claim 1 wherein said guiding means comprises a fixed position fence for guiding each of said articles to the conveying nip of said first pair of rollers.

9. Apparatus as set forth in claim 8 wherein said fence includes a pivot point in line with the centerline of said first pair of rollers about which said articles are rotated.

10. Apparatus as set forth in claim 9 further comprising means for biasing received articles to be grabbed by the nip of said first pair of rollers.

11. Apparatus as set forth in claim 9 wherein said fixed fence includes a member which said articles initially engage while traversing said first path to cause each article to be biased towards said nip of said first pair of rollers.

12. Apparatus as set forth in claim 1 wherein said urging means comprises:

(a) a solenoid; and (b) a pin, driven by said solenoid, which in said first mode is below said flat surface and in said second mode is above said flat surface.

13. Apparatus as set forth in claim 1 wherein said preselected angle of rotation of each said articles is 90° in said first mode and 180° in said second mode.

14. A method for turning flat articles, comprising:

(a) receiving a serial stream of said articles each traveling along a first linear path;

(b) rotating each of said received articles through a preselected angle and steering each of said articles in a preselected direction of travel wherein said rotating and steering is performed by a first and second pair of fixed, positioned rollers the axes of which are located substantially at right angles to one another, each of said roller pairs including a drive roller and an idler roller, said rotating and steering further including, in a first mode, urging said articles to continue along said first linear path and, in a second mode, urging said articles to take a second linear path at a right angle to said first linear path;

(c) guiding each of said received articles to at least said first pair of rollers;

(d) driving said drive rollers; and (e) conveying each article rotated down a path parallel with said preselected direction of travel.

15. A method as set forth in claim 14 wherein said step of receiving further includes the step of supporting, on a substantially flat surface, each of said serially received articles.

16. A method as set forth in claim 14 further comprising the step of biasing said idler rollers to accommodate articles of varying thickness.

17. A method as set forth in claim 14 wherein the step of rotating and steering further comprises the step of pivoting each article about a pivot point in line with the centerline of said first pair of rollers.

18. A method as set forth in claim 14 further comprising the step of rotating each article 90° in said first mode and rotating each article 180° in said second mode.

* * * * *